US010634385B2

(12) United States Patent
Anderson et al.

(10) Patent No.: US 10,634,385 B2
(45) Date of Patent: Apr. 28, 2020

(54) HEAT BALANCING SYSTEM

(75) Inventors: Peter Anderson, St. Paul, MN (US); Shanna Lorraine Leeland, St. Paul, MN (US)

(73) Assignee: Ademco Inc., Golden Valley, MN (US)

( * ) Notice: Subject to any disclaimer, the term of this patent is extended or adjusted under 35 U.S.C. 154(b) by 241 days.

(21) Appl. No.: 12/769,081

(22) Filed: Apr. 28, 2010

(65) Prior Publication Data

US 2011/0048340 A1 Mar. 3, 2011

Related U.S. Application Data

(63) Continuation-in-part of application No. 12/553,795, filed on Sep. 3, 2009, now Pat. No. 8,297,524.

(51) Int. Cl.
*F24H 9/20* (2006.01)
*F24H 1/20* (2006.01)

(52) U.S. Cl.
CPC ..... *F24H 9/2035* (2013.01); *F24H 1/205* (2013.01)

(58) Field of Classification Search
USPC ..... 122/14.22, 14.2, 14.31; 431/6, 20; 236/1 G
See application file for complete search history.

(56) References Cited

U.S. PATENT DOCUMENTS 2,254,960 A * 9/1941 Harris ..... G05D 23/12 236/16
2,278,927 A 4/1942 Hemry
3,708,737 A 1/1973 Johnson
3,818,297 A 6/1974 Ha et al.
3,847,350 A 11/1974 Thompson
3,849,350 A 11/1974 Matsko
4,204,833 A 5/1980 Kmetz et al.
4,256,257 A 3/1981 Pinkerton
4,267,965 A 5/1981 Everett
4,299,554 A 11/1981 Williams
4,324,944 A 4/1982 Weihrich et al.
RE30,936 E 5/1982 Kmetz et al.
(Continued)

FOREIGN PATENT DOCUMENTS

EP 0356609 3/1990
GB 2211331 6/1989

OTHER PUBLICATIONS

U.S. Appl. No. 12/553,795, filed Sep. 3, 2009.
(Continued)

*Primary Examiner* — Nathaniel Herzfeld
(74) *Attorney, Agent, or Firm* — Shumaker & Sieffert, P.A.

(57) ABSTRACT

A heat balancing system for a natural draft gas burning appliance having a flue. When the appliance is in a standby mode, a main burner is shut off and the pilot light remains on. Temperature in the heat exchanger (e.g., temperature of water in a heater tank) may be decreased or increased, respectively, by opening or closing a damper in a flue as needed. If opening the damper does not sufficiently reduce the temperature of the heat exchanger, then the pilot light may be shut off to further reduce the temperature. The pilot light may be turned on again to bring up the temperature. There may be a control or controller to operate the damper to maintain the temperature of the exchanger within a certain range. Electrical power may be provided for the system from a power line, a storage device, or other source.

12 Claims, 6 Drawing Sheets

(56) References Cited

U.S. PATENT DOCUMENTS

| | | | | |
|---|---|---|---|---|
| 4,333,002 | A | 6/1982 | Kozak | |
| 4,390,123 | A | 6/1983 | McCabe | |
| 4,460,329 | A | 7/1984 | Trent | |
| 4,508,261 | A | 4/1985 | Blank | |
| 4,511,790 | A | 4/1985 | Kozak | |
| 4,538,980 | A | 9/1985 | Hoyme | |
| 4,588,875 | A | 5/1986 | Kozak et al. | |
| 4,692,598 | A | 9/1987 | Yoshida et al. | |
| 4,696,639 | A | 9/1987 | Bohan, Jr. | |
| 4,734,658 | A | 3/1988 | Bohan, Jr. | |
| 4,742,210 | A | 5/1988 | Tsuchiyama et al. | |
| 4,752,210 | A | 6/1988 | Trent | |
| 4,770,629 | A | 9/1988 | Bohan, Jr. | |
| 4,778,378 | A | 10/1988 | Dolnick et al. | |
| 4,834,284 | A | 5/1989 | Vandermeyden | |
| 4,835,670 | A | 5/1989 | Adams et al. | |
| 4,880,376 | A | 11/1989 | Bartels et al. | |
| 4,984,981 | A | 1/1991 | Pottebaum | |
| 4,986,468 | A | 1/1991 | Deisinger | |
| 5,007,156 | A | 4/1991 | Hurtgen | |
| 5,039,006 | A * | 8/1991 | Habegger | 236/11 |
| 5,276,630 | A | 1/1994 | Baldwin et al. | |
| 5,312,629 | A | 5/1994 | Beres et al. | |
| 5,442,157 | A | 8/1995 | Jackson | |
| 5,447,125 | A * | 9/1995 | McNally et al. | 122/14.1 |
| 5,612,629 | A | 3/1997 | Mullin et al. | |
| 5,622,200 | A | 4/1997 | Schulze | |
| 5,652,525 | A | 7/1997 | Mullin et al. | |
| 5,660,328 | A | 8/1997 | Momber | |
| 5,797,358 | A | 8/1998 | Brandt et al. | |
| 5,896,089 | A | 4/1999 | Bowles | |
| 5,968,393 | A | 10/1999 | Demaline | |
| 5,975,884 | A | 11/1999 | Dugger | |
| 6,048,193 | A | 4/2000 | Juntunen et al. | |
| 6,053,130 | A | 4/2000 | Shellenberger | |
| 6,059,195 | A | 5/2000 | Adams et al. | |
| 6,208,806 | B1 | 3/2001 | Langford | |
| 6,257,871 | B1 | 7/2001 | Weiss et al. | |
| 6,261,087 | B1 | 7/2001 | Bird et al. | |
| 6,271,505 | B1 | 8/2001 | Henderson | |
| 6,293,471 | B1 | 9/2001 | Stettin et al. | |
| 6,350,967 | B1 | 2/2002 | Scott | |
| RE37,745 | E | 6/2002 | Brandt et al. | |
| 6,560,409 | B2 | 5/2003 | Troost, IV | |
| 6,584,197 | B1 | 6/2003 | Boudreaux, Jr. et al. | |
| 6,644,957 | B2 | 11/2003 | Weiss | |
| 6,684,821 | B2 | 2/2004 | Lannes et al. | |
| 6,701,874 | B1 | 3/2004 | Schultz et al. | |
| 6,838,847 | B2 | 1/2005 | Dragoni et al. | |
| 6,880,493 | B2 | 4/2005 | Clifford | |
| 6,934,862 | B2 | 8/2005 | Sharood et al. | |
| 6,955,301 | B2 | 10/2005 | Munsterhuis et al. | |
| 6,959,876 | B2 | 11/2005 | Chian et al. | |
| 7,205,737 | B1 | 4/2007 | Bilodeau | |
| 7,205,892 | B2 | 4/2007 | Luebke et al. | |
| 7,221,862 | B1 | 5/2007 | Miller et al. | |
| 7,252,502 | B2 | 8/2007 | Munsterhuis | |
| 7,275,533 | B2 | 10/2007 | Soeholm et al. | |
| 7,317,265 | B2 | 1/2008 | Chian et al. | |
| 7,712,677 | B1 | 5/2010 | Munsterhuis et al. | |
| 7,721,972 | B2 | 5/2010 | Bracken et al. | |
| 7,747,358 | B2 | 6/2010 | Troost et al. | |
| 7,804,047 | B2 | 9/2010 | Zak et al. | |
| 8,082,888 | B2 * | 12/2011 | Lannes et al. | 122/14.2 |
| 8,113,823 | B2 | 2/2012 | Guzorek | |
| 8,297,524 | B2 | 10/2012 | Kucera et al. | |
| 2003/0075118 | A1 * | 4/2003 | Lannes et al. | 122/14.2 |
| 2003/0170578 | A1 * | 9/2003 | Weiss | 431/20 |
| 2005/0066958 | A1 * | 3/2005 | Guzorek | 126/285 R |
| 2005/0161518 | A1 | 7/2005 | Munsterhuis | |
| 2005/0247304 | A1 | 11/2005 | Weiss | |
| 2006/0150925 | A1 * | 7/2006 | Akkala et al. | 122/14.1 |
| 2006/0214015 | A1 | 9/2006 | Furakawa et al. | |
| 2007/0023333 | A1 | 2/2007 | Mouhebaty et al. | |
| 2007/0187519 | A1 * | 8/2007 | Bracken | F24H 9/20 236/11 |
| 2007/0281257 | A1 * | 12/2007 | Hughes | F23N 5/102 431/22 |
| 2010/0173252 | A1 | 7/2010 | Bracken et al. | |
| 2011/0048340 | A1 | 3/2011 | Anderson et al. | |
| 2011/0270544 | A1 | 11/2011 | Kucera et al. | |

OTHER PUBLICATIONS

U.S. Appl. No. 12/770,908, filed Apr. 30, 2010.

Honeywell D896 Automatic Vent Damper, Product Data, 12 pages, 1997.

Honeywell S8610U Universal Intermittent Pilot Module, Installation Instructions, 20 pages, Aug. 1996.

Johnson Controls Q135 Automatic Flue Damper System, 8 pages, 1998.

Lennox, "Network Control Panel (NCP), User's Manual," 18 pages, Nov. 1999.

Weil-McLain, Technical Services Bulletin No. SB201, 2 pages, Nov. 20, 2002.

Wohlfarth, "The misunderstood barometric damper", PME, accessed from https://www.pmengineer.com/articles/90570-the-misunderstood-barometric-damper, Feb. 13, 2013, 4 pp.

* cited by examiner

HEAT BALANCING SYSTEM

This application is a continuation-in-part of U.S. patent application Ser. No. 12/553,795, filed Sep. 3, 2009, and entitled "A Damper Control System". U.S. patent application Ser. No. 12/553,795, filed Sep. 3, 2009, is hereby incorporated by reference.

U.S. patent application Ser. No. 11/276,121, filed Feb. 15, 2006, and entitled "Appliance Control with Automatic Damper Detection", is a related application. U.S. patent application Ser. No. 11/276,121, filed Feb. 15, 2006, is hereby incorporated by reference.

BACKGROUND

The present invention pertains to devices for building control systems and particularly damper control devices. More particularly, the invention pertains to damper control devices for fuel fired appliances.

SUMMARY

The invention is a heat balancing system for a natural draft gas burning appliance having a flue. When the appliance is in a standby mode, a main burner is shut off and the pilot light remains on. Blocking the flue may cause significant heat rise in a water tank (e.g., water heater) due to heat from the pilot light. Temperature in the heat exchanger (e.g., temperature of water in a heater tank) may be maintained by opening and closing a damper in a flue as needed. If opening the damper does not sufficiently reduce the temperature of the heat exchanger, then the pilot light may be shut off to further reduce the temperature. The temperature of the exchanger may fall further than desired due to a lack of heat in the stand-by mode. Thus, the pilot light may be turned on again to bring up the temperature. There may be a control or controller to operate the damper to maintain the temperature of the exchanger within a certain range. The damper may be operated as completely open and closed, or partially open and closed.

Electrical power may be provided from line power, a storage device or other source for the control or controller, an electrical drive for the damper, pilot light shut-off valve, and other like items as needed for the heat exchanger. In the case of the storage device, it may be recharged with a light- or heat-to-electric converter. The light or heat may be provided by the pilot light.

DESCRIPTION

Flue dampers may greatly improve the efficiency of natural draft gas burning appliances. However, when used with a standing pilot system, blocking the flue may cause excessive heat rise in the heat exchanger due to heat from the pilot. This phenomenon appears especially true in water heaters. Blocking the flue on a standing pilot water heater may result in excessive water temperature eventually causing a relief valve or a high limit switch to open.

Figure 1:
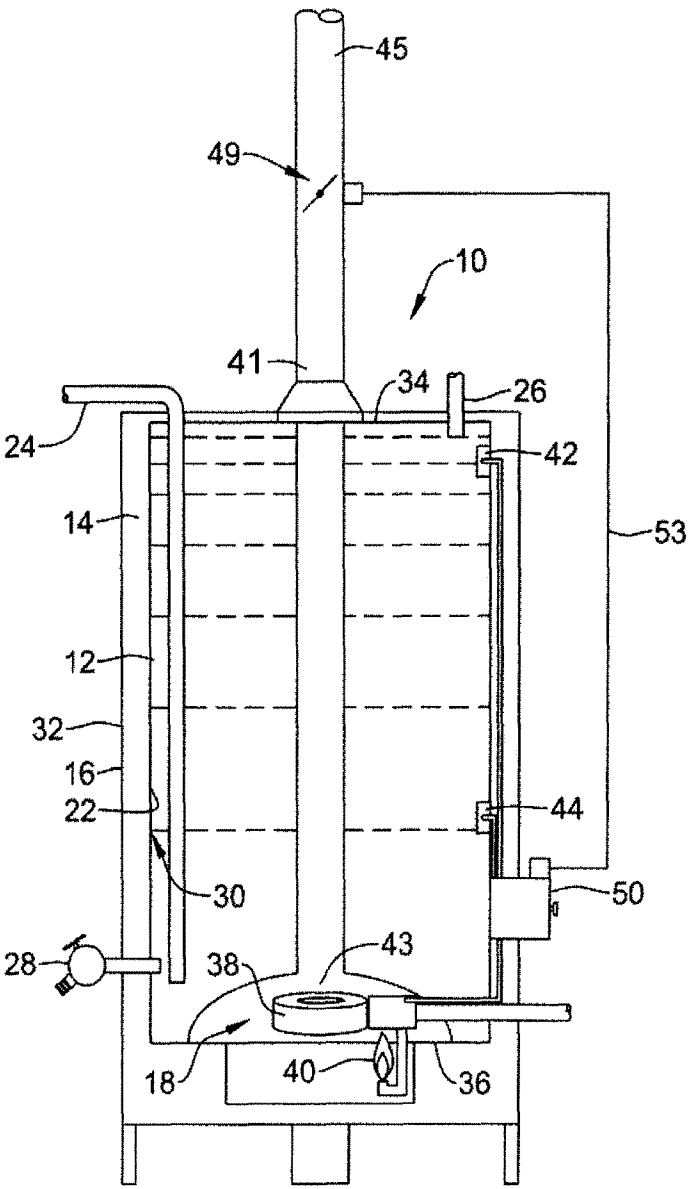
FIG. 1 is a diagram of cutaway side view of an illustrative fuel fired appliance.

FIG. 1 is cutaway view of an illustrative example of a natural gas burning appliance such as a water heater 10. The illustrative water heater 10 may incorporate a tank 12, an insulating layer 14, an external shell 16, a heater 18, and a controller 50. Tank 12 may hold water that is to be heated and be constructed of steel or other heat conducting material. Tank 12 may have an inner surface 22, an input supply tube or dip tube 24, an output conduit or pipe 26, a drainage valve 28, a rust inhibiting liner 30, and an outer surface 32.

Insulating layer 14 may be located between outer surface 32 of tank 12 and external shell 16. Insulating layer 14 may limit or otherwise minimize the heat loss of the heated water from passing from tank 12 to the outside world. Bonded to the inside of inner surface 22 may be a rust inhibiting liner 30. In addition, tank 12 may have a sacrificial anode rod (not illustrated) to keep tank 12 from corroding, and have flue baffling which is designed to optimize heat exchange between combustion by-products and water. It may be like a secondary heat exchanger.

Tank 12 may also have a top surface 34 and a bottom surface 36. Dip tube 24 and output pipe 26 may pass through top surface 34. Output pipe 26 may extend through top surface 34 to a second predetermined distance from bottom surface 36. This second predetermined distance may be fairly close to top surface 34.

Heater 18 may heat tank 12 and tank 12 may heat water inside it. Temperature of the water in tank 12 may be detected by one or more temperature sensors 42 and 44, which are connected to controller 50. Heater 18 may have one or more gas-fired burners 38 and a pilot 40 located in a combustion chamber 43.

The heat output of heater 18 may be controlled by burner orifice size, gas pressure, and/or time. To produce heat in the gas-fired water heater, gas may flow into burner 38 in the combustion chamber 43 through the gas-flow valve, where pilot source 40 ignites the gas. Pilot 40 may also produce heat resulting in heating the water or keeping it hot. The gas may continue to burn until the supply of gas is terminated. The burner 38 and pilot 40, which are situated in combustion chamber 43, may be in fluid communication with an exhaust outlet, such as a flue 41. The flue 41 may be coupled to a vent pipe 45 that vents combustion gases exiting from the combustion chamber 43 to the atmosphere (e.g., outside of the building).

In some cases, the combustion gases may be vented via flue 41 and vent pipe 45 through natural convection. Alternatively, a fan or like (not shown) may be provided to help force the combustion gases through the flue 41 and vent pipe 45 to the atmosphere. In either case, during off-cycle periods, the water heater 10 may lose heat through the flue 41 and vent pipe 45 to the atmosphere by natural convection and conduction. To help reduce these losses, a damper 49 may be installed either at the flue 41 exit or in the vent pipe 45.

In some cases, one or more electric motor controlled dampers may be used. The damper 49 shown in FIG. 1 may be one such electric motor controlled damper. The damper 49 may be controlled by a controller 50 or the like via wiring 53. In some cases, the damper 49 may be controlled to open when combustion of either burner 38 and/or pilot 40 in the combustion chamber 43 starts, and close immediately or sometime after combustion stops. This may help minimize the off-cycle heat losses that may occur through natural convection through the vent pipe 45 to the atmosphere.

Figure 2:
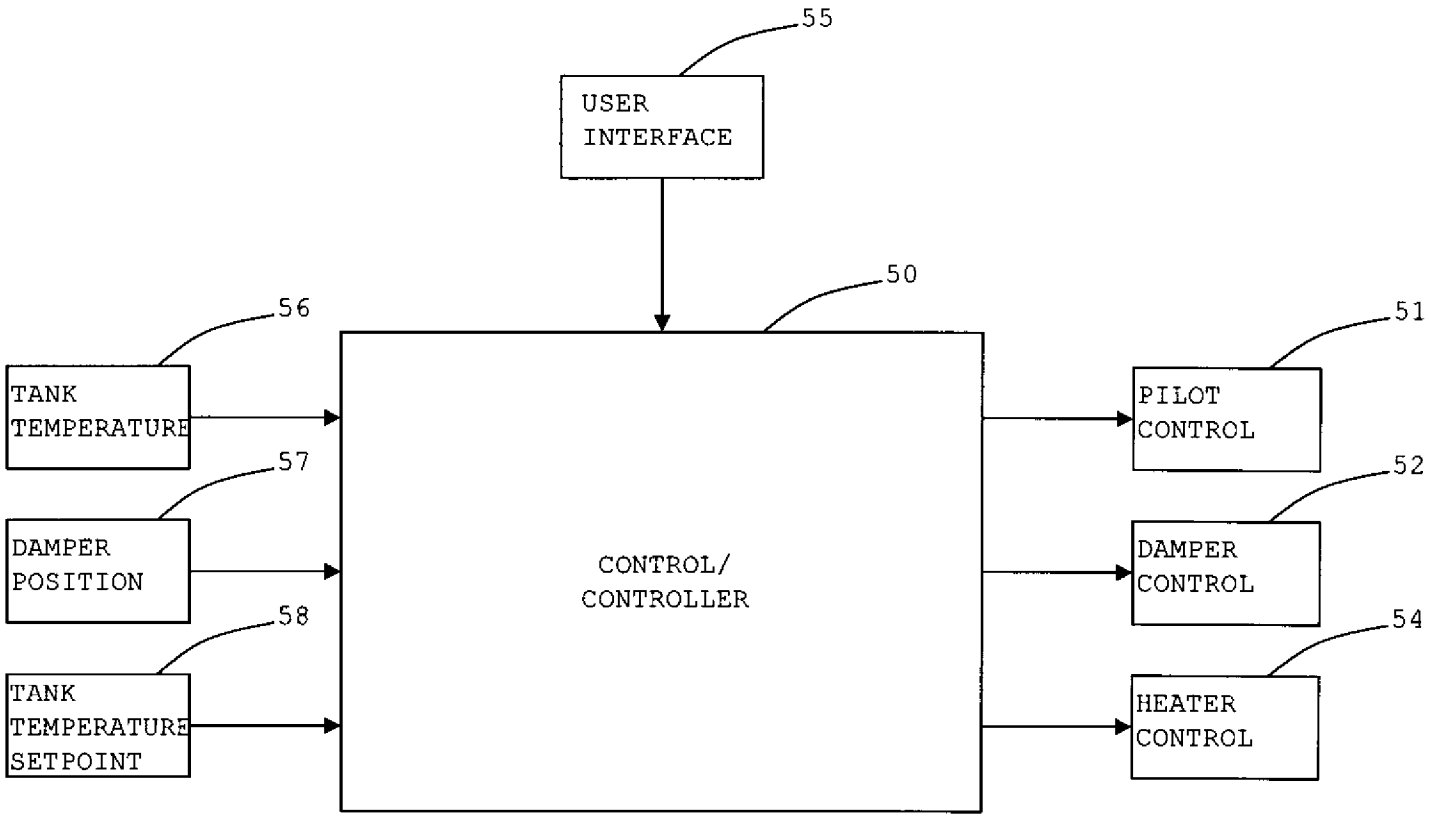
FIG. 2 is a diagram of an illustrative controller for operating and/or controlling the appliance of FIG. 1.

FIG. 2 is a block diagram of a control or controller 50. A user interface 55 of controller 50 may be for control, entry, observing a display, and so forth. User interface 55 may be utilized for installing a program or function in controller 50 to control burner 38, pilot 40 and damper 49 control in appliance 10. An input 56 to controller 50 may be for receiving tank 12 water temperature indications from sensors 42 and 44. An input 57 to controller 50 may be for receiving a damper 49 position in flue 41 or vent pipe 45. An input 58 to controller 50 may be for receiving a tank temperature setpoint. An output 51 from controller 50 may be for controlling pilot 40. An output 52 from controller may be for controlling damper 49. An output 54 may be for controlling burner 38.

The present approach may solve the problem of excessive heat rise in an appliance, for example, a water heater, by controlling the damper based on the temperature of a medium. In the case of a water heater, water temperature may be monitored. When the appliance off-state or off-cycle (i.e., the burner is not running or the main fuel valve is closed) temperature is seen to be rising, or when it exceeds a threshold, the damper may be opened by some amount to allow heat loss up the flue. Instead of water temperature; air temperature, a temperature of the heat exchanger itself, or some other temperature indication may be used.

One way to control heat rise is to cut a relief area in the damper plate to allow heat to escape. While effective, the relief area should be fine-tuned to each appliance and even to different installations. In addition, a relief area may directly reduce the effectiveness of the damper's impact on efficiency. It is likely that many installations will have more relief area than required to maintain a constant temperature or keep from resulting in a dropping temperature. Heat rise may be controlled also by making the damper smaller than necessary so that the relief area is the distance between the damper and the flue (circular dimension) and not a notch in the center of the damper.

A water heater control may be capable of measuring water temperature in the tank and be in control of the flue damper. It may be in direct control of the damper or it may provide signals to a separate damper controller. During the off-cycle, a situation may be that the pilot is burning, the main fuel (e.g., gas) valve is off, and the damper is closed. In some cases, this situation may lead to heating of the water due to the pilot flame, particularly in significantly energy efficient or small water heaters. The control or controller may continue to monitor water temperature. If the water temperature is approaching some first threshold value, then the damper may be opened to allow heat to escape up the flue. Once the temperature comes down below a second threshold value, the damper may be closed again. The first threshold value is greater than the second threshold value.

Alternatively, the control may partially open the damper in an attempt to balance heat loss and maintain a somewhat constant water temperature. In this case, the damper may be continually adjusted to basically maintain a setpoint temperature in the off-cycle.

The present approach may be extended further to encompass intermittent pilot systems as well. Using the fact that the pilot may be capable of adequately warming the heat exchanger (e.g., the tank of a water heater) with the damper closed, a control may light the pilot to satisfy light heating demands and leave the main fuel valve closed. More than needed heat may be balanced by using the damper or cycling the pilot. In flame-powered systems, the control may be required to periodically light the pilot to recharge batteries or capacitors via thermocouples, solar cells, or other heat or light to electric energy converters. In this case, the damper may be used to guard against overheating the appliance during the battery or capacitor recharge phase.

One may have a standing pilot and millivolt (mV) damper control strategy for prevention of tank failure due to overheating. Flue dampers have not been successfully applied to smaller fossil fuel water heaters due to hazards of overheating. Sizing a pilot may require a minimum orifice opening to pass agency testing when running at reduced rates to ensure that the main burner light is off. If one wishes to apply a damper to the fossil fuel appliance, one will likely compromise appliance optimization in order to prevent heat build up in the flue chamber during a standby mode with the pilot operating. This heat build-up may eventually blow the temperature and pressure relief (T&P) valve or a high temperature limit.

Because many manufacturers may prefer a standing pilot approach that does not require additional outside electricity to be introduced, and can be used in existing systems which utilize metal flue piping (i.e., no need to convert to PVC as it may be very expensive). The algorithm herein may allow manufacturers to maximize insulation on a tank to reduce standby losses, and yet prevent a water vessel from becoming overheated due to the minimum orifice size needed for the standing pilot application. The secondary effect of this system may be an increase in efficiency by ensuring that heat from the standing pilot has an opportunity to be transferred into the tank without overheating it.

One may have an intermittent pilot and millivolt damper control strategy for optimization of heat transfer of the pilot during long standby periods without over-temping the tank. Again, many manufacturers may prefer a standing pilot system that does not require additional outside electricity to be introduced or new flue piping added. The algorithm herein may allow manufacturers to maximize insulation on a tank to reduce standby losses, prevent a water vessel from becoming overheated due to the minimum size orifice needed for the standing pilot application, introduce intermittent spark as an approach to relight the pilot when tank is at setpoint during standby, and also use short pulse burns with the pilot to keep the tank at setpoint for long periods of time without the need to fire the main burner.

Figure 3:
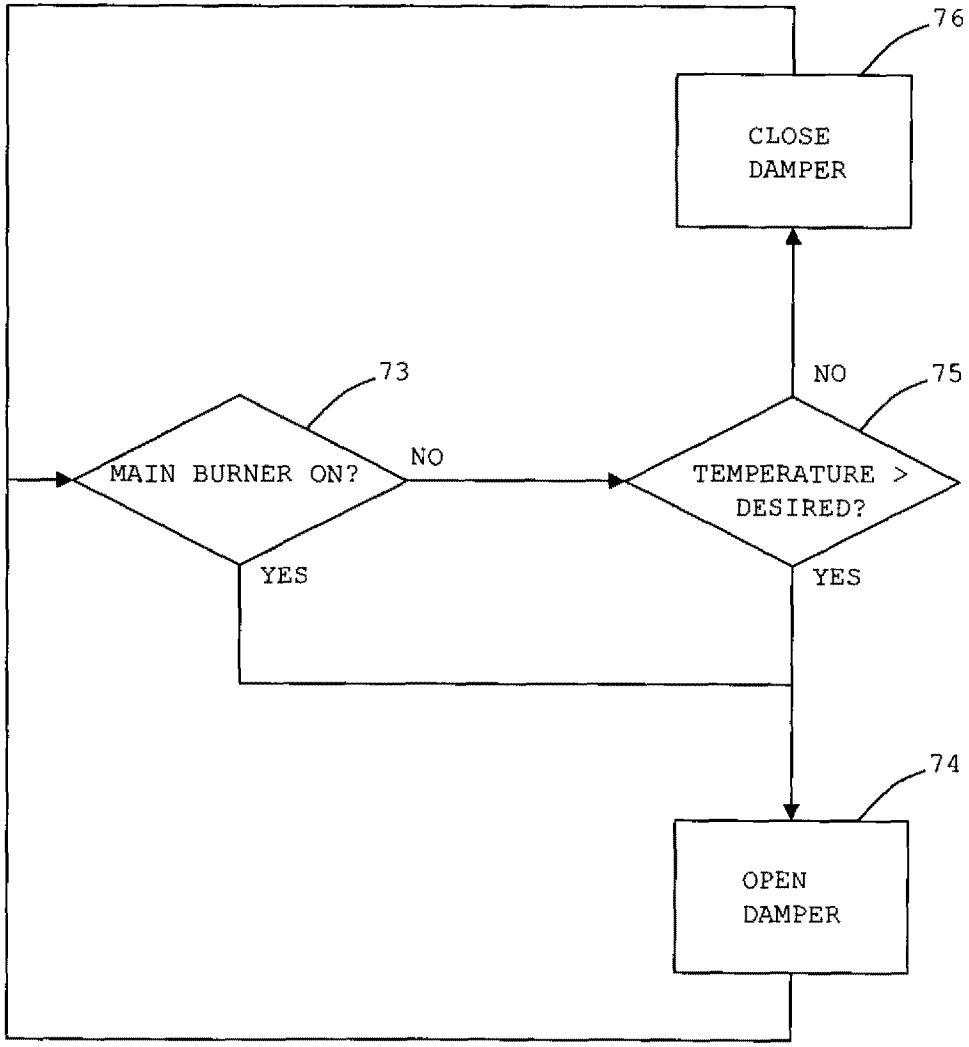
FIG. 3 is a flow diagram showing temperature control using basic open and closed positions of a damper.

FIG. 3 is a flow diagram showing temperature control using basic discrete open and closed positions of a damper. At symbol 73 may be a question of whether the main burner is on (or there is a request to turn the main burner on). If the answer is yes, the damper is opened at symbol 74. If the answer is no, then a question of whether the temperature is greater than a desired temperature may be asked at symbol 75. If the answer is yes, then the damper is opened at symbol 74. If the answer is no, then the damper is closed at symbol 76. The positions of the damper may be fed from symbols 74 and 76 to symbol 73.

Figure 4:
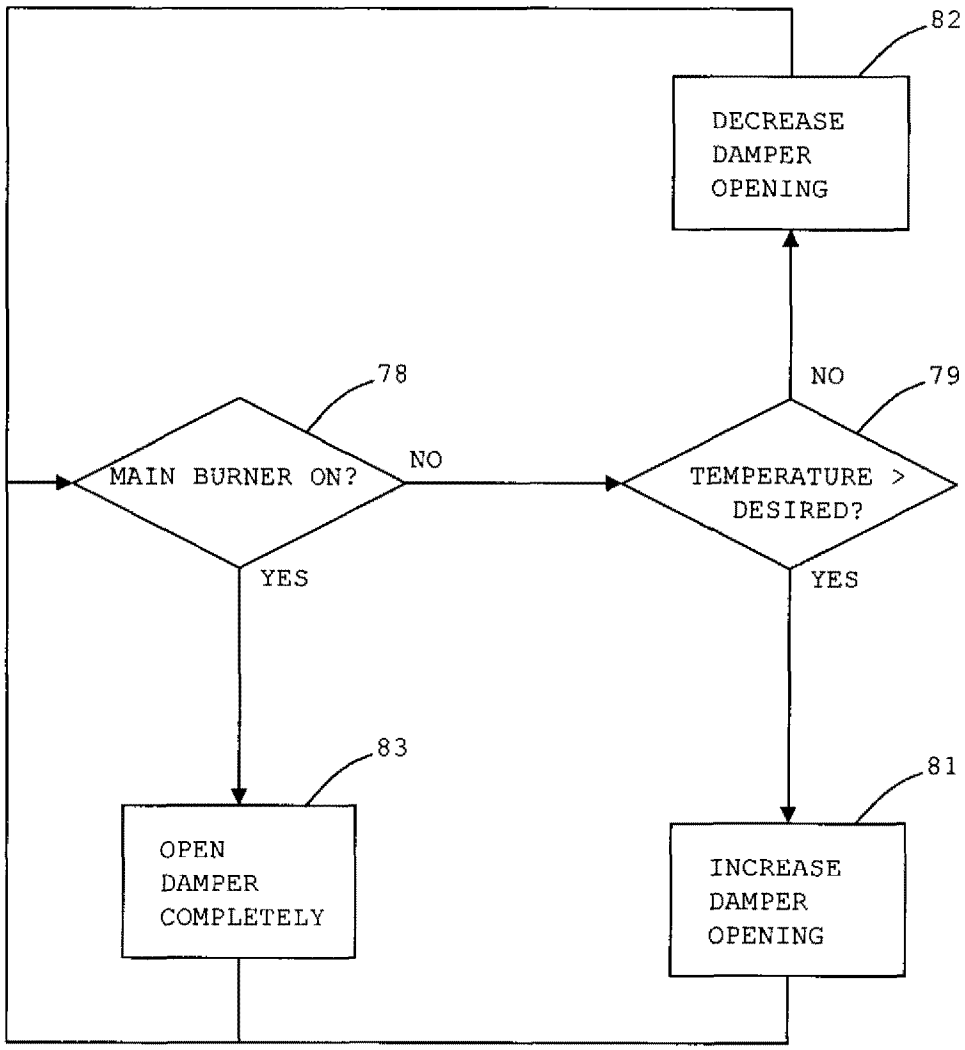
FIG. 4 is a flow diagram showing temperature control using variable positions of the damper.

FIG. 4 is a flow diagram showing temperature control using variable or partially open and partially closed positions of the damper. At symbol 78 may be a question of whether the main burner is on (or there is a request to turn the main burner on). If the answer is yes, then the damper may be opened completely at symbol 83. If the answer is no, then a question of whether the temperature is greater than a desired may be asked at symbol 79. If the answer is yes, then the opening of the damper may be increased at symbol 81. If the answer is no, then the opening of the damper may be decreased at symbol 82.

Figure 5:
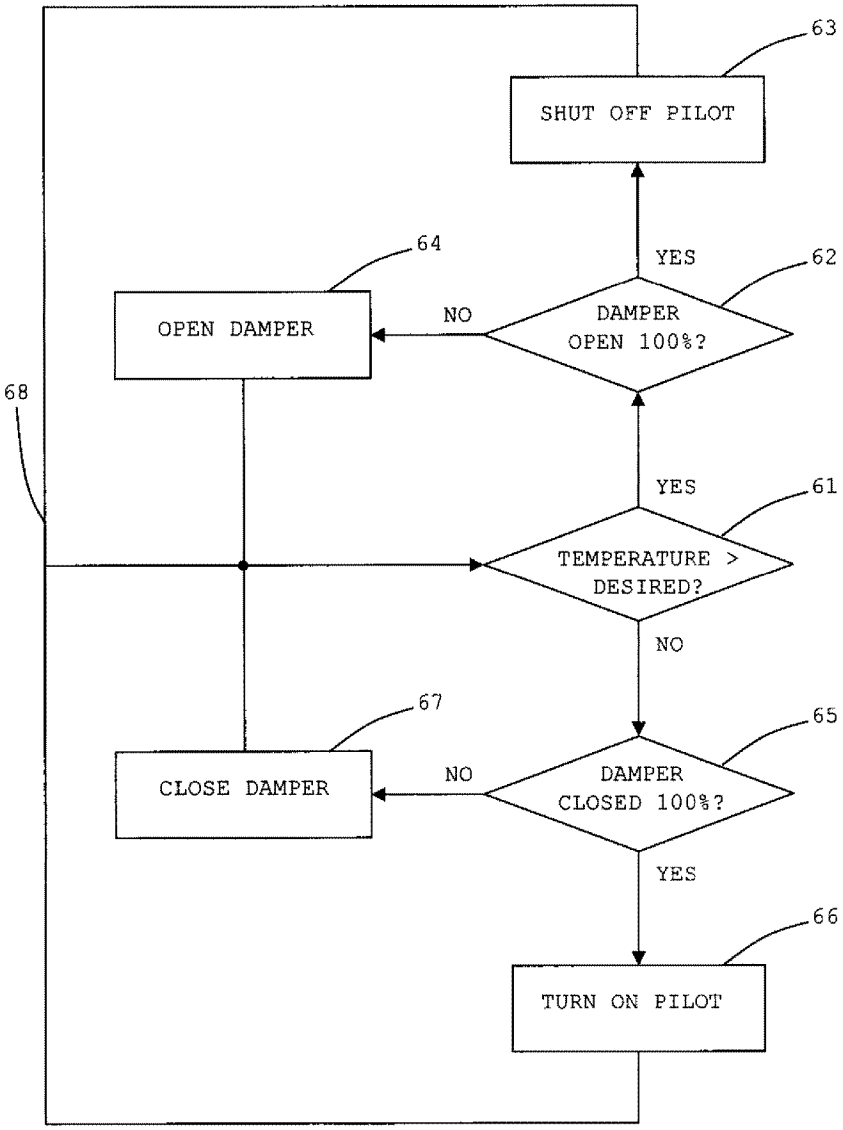
FIG. 5 is a flow diagram showing heating water in a heater tank with just a pilot light.

FIG. 5 is a flow diagram showing controlling heating water in the heater tank with just a pilot light. A question of whether the temperature of the water in a heater tank is greater than desired is asked at symbol 61. If the answer is yes, then a question of whether the damper is open 100 percent may be asked at symbol 62. If the answer is yes, then the pilot may be shut off at symbol 63. If the answer is no, then the damper may be opened at symbol 64. If the answer to the question at symbol 61 is no, then a question of whether the damper is closed 100percent may be asked at symbol 65. If the answer is yes, then the pilot may be turned on at symbol 66. If the answer is no, then the damper may be closed at symbol 67. Indications of the status of the pilot light and the damper may be fed to symbol 61 via lines 68.

Figure 6:
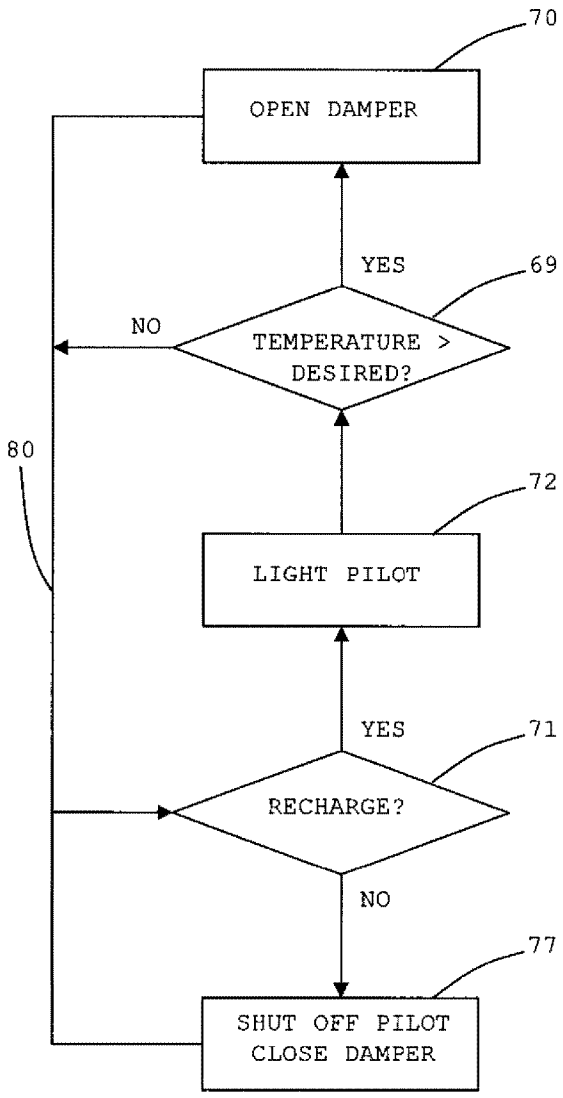
FIG. 6 is a flow diagram showing a recharge with over-temperature protection.

FIG. 6 is a flow diagram showing a recharge with over-temperature protection. A question of whether the temperature of the water in the heater tank is greater than desired may be asked at symbol 69. If the answer is yes, then the damper may be opened at symbol 70. If the answer is no, then a question of whether there should be a recharge may be asked at symbol 71. If the answer is yes, then the pilot may be lighted at symbol 72. If the answer is no, then the pilot may be shut off and the damper be closed at symbol 77. The status of the pilot light and the damper may be fed to symbol 71 via lines 80.

In the present specification, some of the matter may be of a hypothetical or prophetic nature although stated in another manner or tense.

Although the present system has been described with respect to at least one illustrative example, many variations and modifications will become apparent to those skilled in the art upon reading the specification. It is therefore the intention that the appended claims be interpreted as broadly as possible in view of the prior art to include all such variations and modifications.

What is claimed is:

1. A water heater having heat balancing comprising:
- a water tank;
- a combustion chamber proximate to the water tank;
- a burner situated in the combustion chamber;
- a pilot light for igniting the burner;
- a flue for conveying out exhaust gases from the combustion chamber;
- a damper situated in the flue for blocking the exhaust gases when the damper is closed;
- a temperature sensor situated to measure temperature of water in the water tank; and
- a controller connected to the damper, the temperature sensor and the pilot light;

wherein:
- when the water heater is in a standby mode the burner is off and the pilot light is on; and
- when the water heater is in a standby mode, the controller controls a position of the damper in response to the temperature of the water tank to maintain the temperature within the water tank at a desired temperature setpoint value, wherein
  - if the damper is open and the pilot light increases the temperature of the water tank beyond a first threshold temperature, then the pilot light is shut off; and
  - if the temperature of the water tank becomes less than a second threshold, then the controller turns the pilot light back on, wherein the first threshold is greater than the second threshold and wherein the damper can be either open or closed when the pilot light is turned on.

2. The water heater of claim 1, wherein:
- when the water heater is in the standby mode the control opens the damper when the temperature of the water tank exceeds the temperature setpoint plus X degrees F.; and
- when the water heater is in the standby mode the control closes the damper when the temperature of the water tank is less than the temperature setpoint.

3. The water heater of claim 1 wherein:
- the control opens the damper when the temperature of the water tank exceeds a first threshold;
- the control closes the damper when the temperature of the water tank becomes less than a second threshold; and
- the first threshold is greater than the second threshold.

4. The water heater of claim 1, wherein:
- the control partially closes or opens the damper to maintain the temperature of the water tank approximately at the desired setpoint, with the temperature sensor providing the temperature of the water tank to the control; and
- the desired setpoint is less than a scalding temperature and a relief valve opening point temperature.

5. The water heater of claim 4, wherein:
- the control is connected to the pilot light; and
- if the control completely opens the damper to bring the temperature of the water tank down to the desired setpoint and the temperature of the water tank remains above the desired setpoint, then the control shuts off the pilot light.

6. The water heater of claim 5, wherein if the temperature of the water tank reaches X degrees F. below the desired setpoint, then the control turns on the pilot light.

7. A heat balancing control system for a gas burning appliance comprising:
- a tank;
- a pilot proximate to the tank;
- a flue in communication with the pilot;
- a damper installed at the flue;
- a temperature sensor proximate to the tank; and
- a control connected to the damper and the temperature sensor, the controller configured to maintain a temperature within the tank according to a temperature setpoint value; and
- wherein when the appliance is in a standby mode in which a main burner is off and the pilot is on, the control adjusts a position of the damper according to a temperature indicated by the temperature sensor to keep the temperature of the tank at the temperature setpoint value,
- wherein if the damper is open and the temperature sensor indicates an overheat temperature in that the tank is approaching being overheated, then the pilot is turned off until the temperature sensor indicates a temperature that is X degrees less than the overheat temperature, after which the controller turns on the pilot light.

8. The system of claim 7, wherein the control opens the damper when the temperature sensor indicates a temperature greater than the temperature setpoint plus X degrees C.

9. The system of claim 7, wherein:
- when the appliance is in the standby mode, the damper partially opens when the temperature sensor indicates a temperature greater than the temperature setpoint; and
- when the appliance is in the standby mode the damper partially closes when the temperature sensor indicates a temperature less than the temperature setpoint.

10. The system of claim 7, wherein the control has a look-up table which indicates that the damper is to move to position Y if the temperature sensor indicates a temperature X, to prevent overheating of the tank.

11. The system of claim 7, wherein:

the control completely opens the damper when the temperature sensor indicates a temperature greater than the temperature setpoint; and the control completely closes the damper when the temperature sensor indicates a temperature less than the temperature setpoint.

12. A water heater having heat balancing comprising:

a water tank;

a combustion chamber proximate to the water tank;

a burner situated in the combustion chamber;

a pilot light for igniting the burner;

a flue for conveying out exhaust gases from the combustion chamber;

a damper situated in the flue for blocking the exhaust gases when the damper is closed;

a temperature sensor situated to measure temperature of water in the water tank; and a controller connected to the damper, the temperature sensor and the pilot light;

wherein:

when the water heater is in a standby mode the burner is off and the pilot light is on; and when the water heater is in a standby mode the controller is configured to control a position of the damper in response to the temperature of the water in the water tank to maintain the temperature of the water within the water tank at a desired temperature setpoint value.

* * * * *